US005697878A

United States Patent [19]

Elkis

[11] Patent Number: 5,697,878

[45] Date of Patent: Dec. 16, 1997

[54] PIN STRIPPER

[75] Inventor: Michael Elkis, Columbia, Md.

[73] Assignee: Ward Holding Company, Wilmington, Del.

[21] Appl. No.: 614,479

[22] Filed: Mar. 13, 1996

[51] Int. Cl.[6] ..... B31B 49/02

[52] U.S. Cl. ..... 493/373; 493/342; 493/472; 83/116

[58] Field of Search ..... 493/60, 64, 65, 493/82, 83, 342, 361, 365, 370, 373, 472; 83/113, 115, 116, 117

[56] References Cited

U.S. PATENT DOCUMENTS

| | | | |
|---|---|---|---|
| 3,320,864 | 5/1967 | Zernov | 493/373 |
| 3,877,353 | 4/1975 | Smith et al. | 83/116 |
| 4,295,842 | 10/1981 | Bell | 493/82 |
| 4,530,693 | 7/1985 | Isowa | 83/117 |
| 5,087,237 | 2/1992 | Nunley | 493/342 |
| 5,092,207 | 3/1992 | Kikuchi et al. | 83/116 |
| 5,300,009 | 4/1994 | Bittenbender | 83/117 |

*Primary Examiner*—Joseph J. Hail, III
*Assistant Examiner*—Darren Ark
*Attorney, Agent, or Firm*—Bartlett & Sherer

[57] ABSTRACT

A rotary pin stripper is disclosed for separating scrap pieces of paperboard from finish pieces after the pieces have been cut in a die cutter. In the preferred embodiment, the pin stripper cylinder is supported at mid-length, and the stripper cylinder is readily released for replacement and/or repair, while also providing for torque transmission between two separate, axially extending sections of the eccentric cylinder.

20 Claims, 3 Drawing Sheets

PIN STRIPPER

The present invention relates to machines for printing, die cutting, and otherwise processing individual sheets of paperboard, such as sheets of corrugated, and more particularly to an improved pin stripper for removing relatively small pieces of scrap from the product sheets after such sheets have been cut in a die cutter.

BACKGROUND

Printing and die cutting machines for processing paperboard sheets, such as for the making of paperboard boxes, have long included a stripper for automatically removing the scrap pieces from the finished product pieces, and one of the more common forms of strippers has been the use of rotary pin strippers such as disclosed in U.S. Pat. No. 4,295,842 assigned to the Assignee of the present invention. Such rotary pin strippers are extremely efficient in removing scrap at high speeds. However, the stripper cylinders must be replaced for each change in the cutting pattern; ie, for each change of paperboard product. This requires the time-consuming removal of a large plurality of bolts which is undesirable in high speed production. Also, with the advent of wider and wider processing machines, the axial lengths of the cylinders have become such that the eccentric cylinder must be manufactured in at least two axial sections, and the mid-section of the outer stripper cylinder must be supported.

SUMMARY

These and other serious problems are solved by the present invention in which the necessary torque is transmitted from one eccentric cylinder section to the other, while allowing for relative radial movement between the cylinders, and the mid-section of the stripping cylinder is supported, and with quick-acting means to release the stripping cylinder for each removal and replacement.

DETAILED DESCRIPTION

Figure 1:
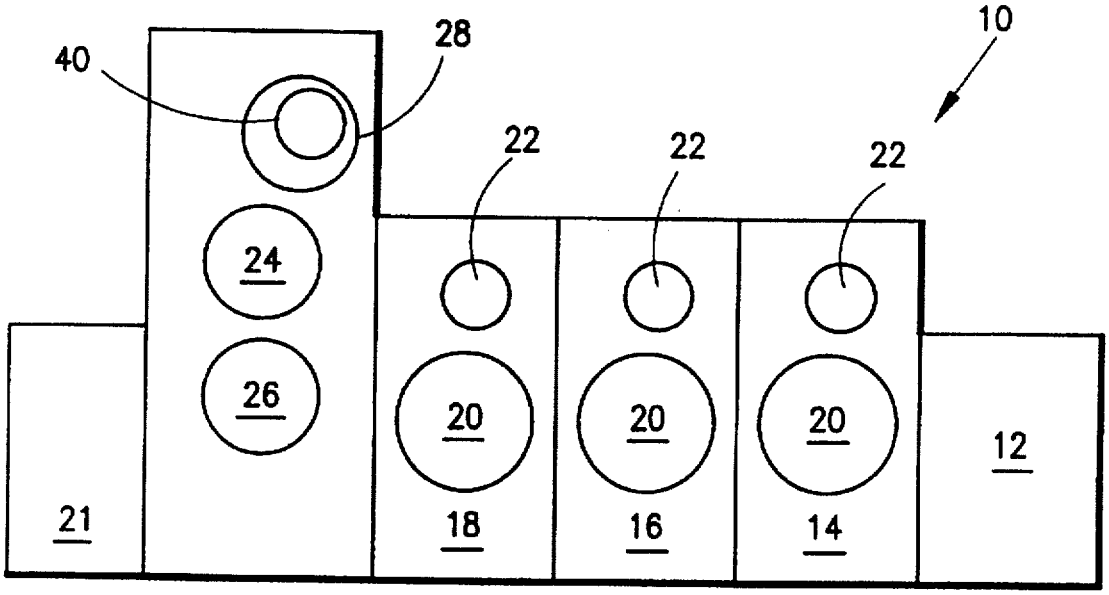
FIG. 1 is a schematic side elevational view of a printing and die cutting machine including the pin stripper of the present invention.

Referring to FIG. 1, a typical printing and paperboard processing machine is schematically illustrated by numeral 10. Such printing and processing machines generally include a feed section 12 which contains a stack of paperboard sheets to be printed, cut and otherwise processed such as to form, for example, corrugated blanks for making corrugated boxes. Machine 10 is further illustrated as including three printing sections 14, 16 and 18 each of which includes a print cylinder 20 and an impression cylinder 22. Of course, it will be understood that more or less printing sections may be included depending upon the type and number of colors of ink to be employed.

After the sheets are printed and before discharge through discharge section 21, it is common practice to pass such sheets between a die cut roll 24 which is mounted above an anvil roll 26 whereby the sheets are cut with flaps, slots or other shapes so that they may be later glued and formed into paperboard boxes. The operation of such die cut and anvil rolls is well known, and it is known that this operation produces a plurality of relatively small-sized pieces of scrap which must be removed from the cut sheet, the latter of which is the product piece. One example of such scrap pieces are the small pieces of corrugated in the multiple slots which are cut in the sheet by the die cutter.

Figure 2:
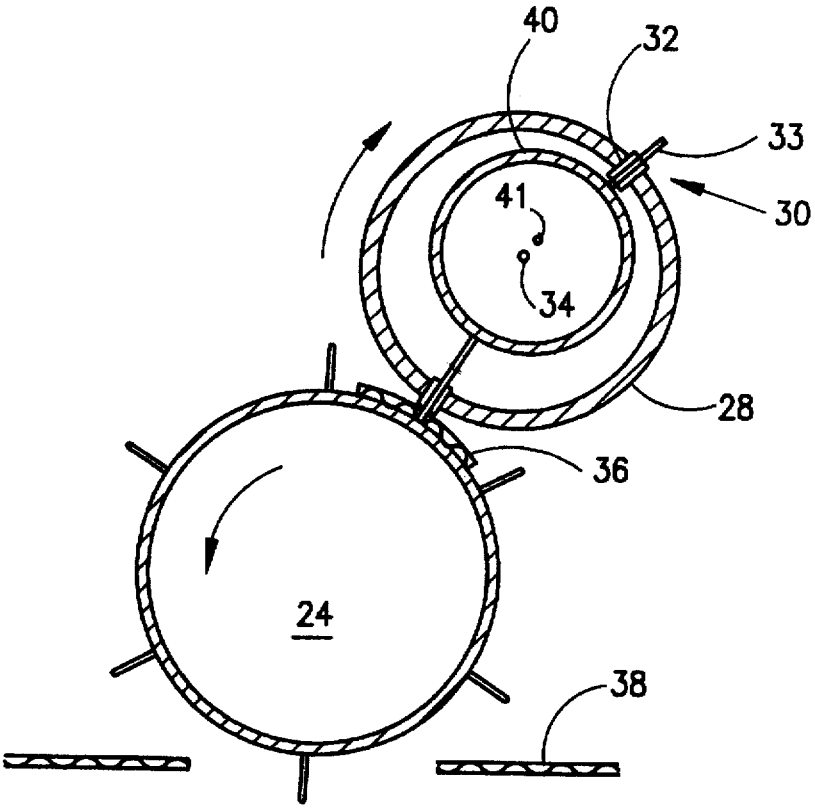
FIG. 2 is a schematic diagram showing the main components of the stripper cooperating with a die cut cylinder to remove pieces of scrap.

It is also known to remove such waste or scrap pieces in what is generally referred to as a pin stripper. FIGS. 1 and 2 schematically illustrate one type of pin stripper which generally comprises an outer cylinder, or stripping die, 28 which carries a large plurality of stripping pin assemblies 30, two of which are illustrated schematically in FIG. 2. Pins 33 are contained within threaded casings 32 which are mounted on stripping cylinder 28 which rotates about its longitudinal axis 34. Pins 33 pierce the scrap pieces, such as scrap piece 36 of paperboard sheet 38, at a predetermined angular position of the die cutter as shown in FIG. 2. An inner eccentric cylinder 40, which rotates about its longitudinal axis 41, moves pin sleeves (not shown) outwardly so as to remove the scrap pieces from the pins at a second angular position. The more detailed structure of such pins, sleeves and pin strippers and the operation thereof are well known and are further described, for example, in U.S. Pat. Nos. 3,320,864, 3,371,584, and 4,295,843, each of which are hereby incorporated by reference.

With the advent of wider processing machines, the longitudinal or axial length of the stripping cylinders has become longer and longer such that serious problems have been encountered in transmitting torque axially through the cylinders. For example, due to the longer requirements of axial length, it has become necessary to fabricate the inner, eccentric cylinder 40 in two separate, axially extending sections such as sections 40A and B shown in FIGS. 3A and 3B. At the same time, the outer stripper cylinders 28 are generally comprised of plywood formed in two circumferentially extending halves, and it is necessary to support these halves by one or more semi-annular support rings such as support ring 44 shown in FIG. 3B. As a result, a portion of ring 44 must pass through the gap between the axial ends of eccentric cylinders 40A and B, and yet, constant torque must be transmitted throughout the entire lengths of both of cylinders 28 and 40.

Figure 3A:
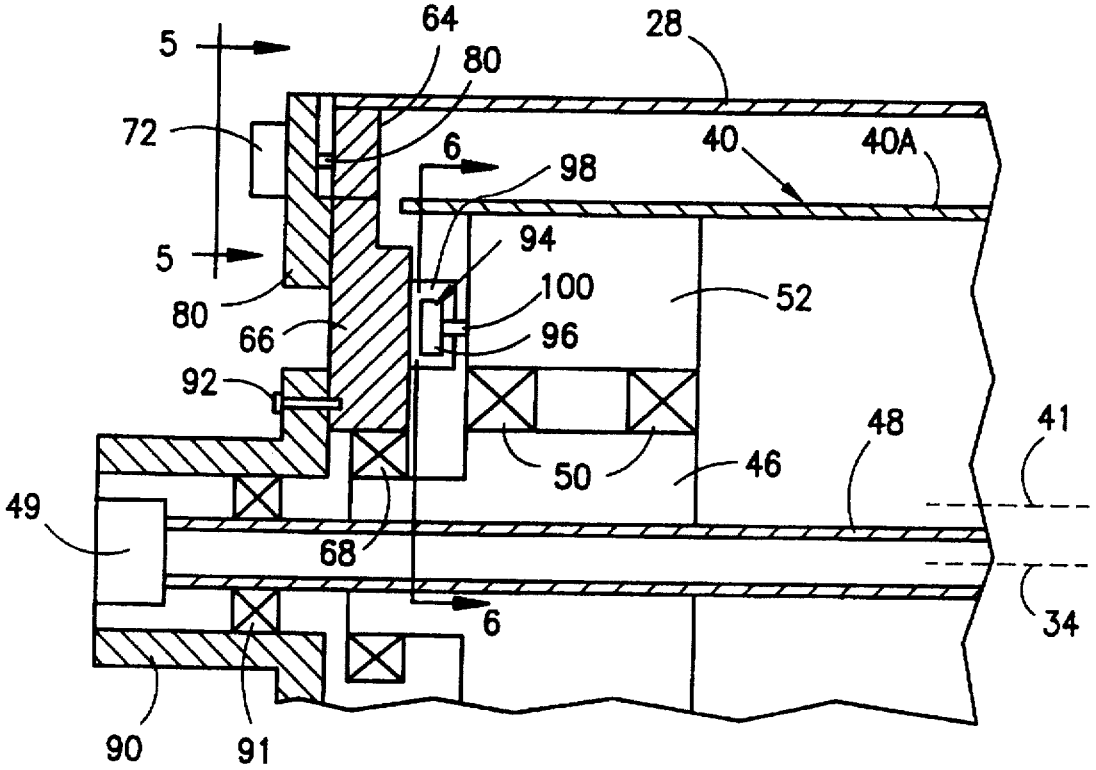
FIGS. 3A and 3B are schematic sectional views showing the stripping and eccentric cylinders and the interconnecting components thereof.
Figure 3B:
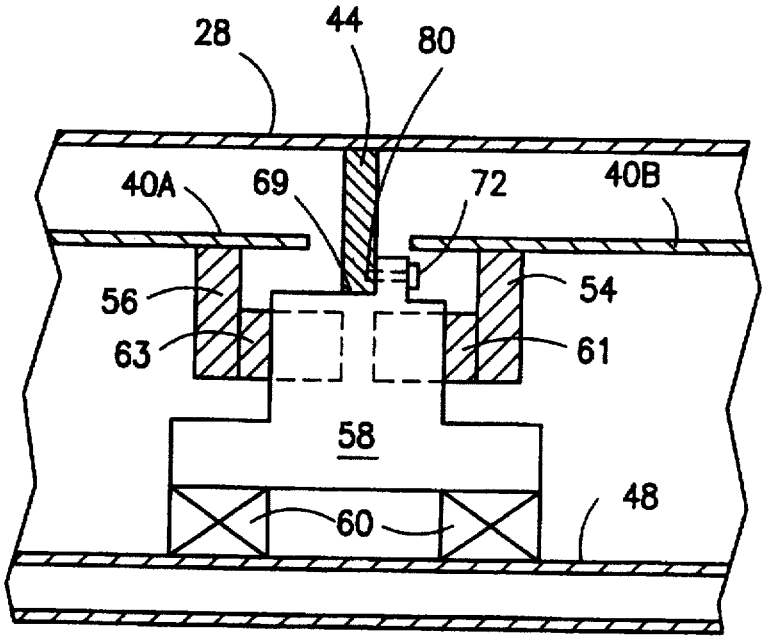

As shown schematically in FIGS. 3A and 3B, this problem is solved by the present invention by first providing eccentric journals 46 on each end of a single support shaft 48. The left end is shown in FIG. 3A and the mid-section is shown in FIG. 3B; it being understood that the right end may be identical to the left end as described. Support shaft 48 extends the full axial length of stripping cylinder 28 and the full axial length of eccentric cylinder sections 40A and B, and shaft 48 is held stationary by conventional shaft mounting means 49. Eccentric journal 46 is fixed to stationary shaft 48, and the eccentric is surrounded by bearings 50. The outer race of the bearings is connected by connector 52 to the inner cylindrical surface of eccentric cylinder section 40A. Similarly, the right hand end of eccentric cylinder section 40B is mounted on an eccentric journal and bearing (not shown) which may be of identical construction. In this manner, both eccentric cylinder sections 40A and B are free to rotate about axis 41 when suitably driven.

However, as previously noted, cylinder sections 40A and 40B must be separated by a gap in order to permit annular support ring 44 to pass therethrough, and support ring 44 must be supported by shaft 48. The present invention provides for torque transmission from one eccentric cylinder section to the other by connecting a pair of annular torque transmission rings 54, 56 to the respective inner surfaces of the adjacent axial ends of the cylinder sections 40A and 40B as shown in FIG. 3B. Transmission rings 54, 56 are connected to an annular connector or bridge piece 58 which is rotatably mounted on stationary shaft 48 by bearings 60. As further shown in FIG. 3B, one preferred structure for connecting rings 54, 56 to bridge piece 58 is to provide a plurality of axially extending plates, rods or fingers 61, 63 which are connected to rings 54, 56, respectively. Fingers 61, 63 slide axially into axial slots, bores or holes in bridge piece 58 and may be connected to each other by bolts (not shown) if desired. Of course, it will be apparent that the slots, bores or holes in bridge piece 58 are of sufficient radial extent to allow for the radial movement of fingers 61, 63 as eccentric cylinders 40A–B rotate about axis 41 as previously described. Thus, the fingers transmit torque from one ring to the other through bridge piece 58. At the same time, the axial fingers enable the two eccentric cylinder sections 40A and B to be axially separated from the bridge piece and from each other for removal and replacement. In addition, the outer annular surface 69 of bridge piece 58 provides a support surface which engages the inner annular surface of support ring 44 so that stripper cylinder 28 may be supported by shaft 48 at multiple points throughout its length.

As further shown in FIG. 3B, the radially outer portion of bridge piece 58 may be removably connected to support ring 44 by a plurality of retractable locking pins 80. Pins 80 may be actuated by compressed air cylinders 72 as will be more fully described hereinafter in connection with the preferred means for mounting cylinder 28 at its opposite ends as well as to support ring 44.

Figure 4:
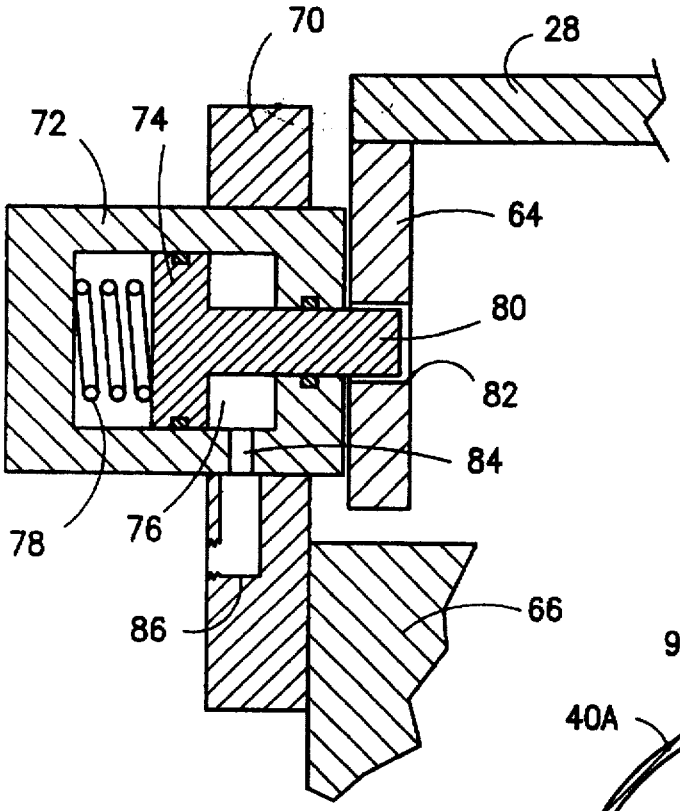
FIG. 4 is an enlarged partial view, in section, showing the removable connection of the stripping cylinder to the end support.

Referring to FIGS. 3A and 4, stripping cylinder 28 is mounted for concentric rotation about axis 34 of stationary shaft 48. In the preferred embodiment, this is accomplished by connecting a semi-circular support ring 64 to the inner surface of one half of the stripping cylinder, and removably connecting semi-circular support ring 64 to an annular end support 66 which is mounted for rotation about a reduced diameter portion of eccentric journal 46 by bearings 68. While semi-circular support ring 64 may be removably connected to end support 66 by various types of connectors, such as by a plurality of removable bolts, the removal of such bolts is time-consuming, and it will be understood that the stripping cylinder must be removed and replaced quite frequently in order to change the pattern of the pins whenever the die cutter is changed to a new cutting pattern.

Figure 5:
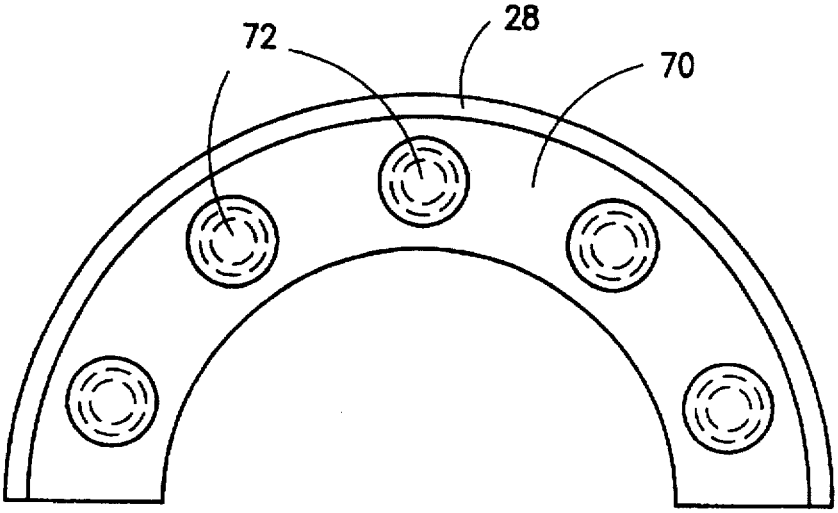
FIG. 5 is a schematic elevational view showing the end of the upper half of the stripping cylinder taken along view line 5—5 of FIG. 3A.

Accordingly, the present invention provides for the mounting of support rings 64 by a plurality of compressed air actuated pins as will now be described with reference to FIGS. 4 and 5.

The upper and lower halves of stripping cylinder 28 may be connected to semi-circular support ring 64 by machine bolts or other known connectors (not shown) and, similarly, end support 66 may be connected to a semi-circular mounting plate 70 by bolts or other known connecting means (not shown). Mounting plate 70 contains a plurality of compressed air cylinders 72 each of which includes a piston 74 slidably mounted in a chamber 76 and biased to the right as viewed in FIG. 4 by a compression spring 78. Piston 74 includes a stem or pin portion 80 which is forced into and maintained in a locking relationship in a hole 82 in semi-circular support ring 64. Thus, when stripping cylinder 28 is mounted in the processing machine 10, locking pins 80 secure the stripping cylinder halves in position by securing semi-circular rings 64 to semi-circular mounting plate 70 which, in turn, is secured to end support 66. However, whenever it is desired to remove the stripping cylinder, compressed air is supplied to chamber 76, such as through bores 84 and 86 in the walls of cylinders 72 and mounting plate 70, respectively, such that piston 74 is moved to the left as viewed in FIG. 4, whereby locking pins 80 are withdrawn from holes 82 and the upper or lower half of the stripping cylinder may be easily and readily removed. Of course, it will also be understood that the foregoing description of pins 80 and cylinders 72 in FIG. 4 also applies to pins 80 and cylinders 72 in FIG. 3B whereby the mid-portion of cylinder 28 may be removably connected through center support 44 to bridge piece 58. It will also be understood that compressed air for cylinders 72 may be supplied through hollow shaft 48 and through bores (not shown) in bridge piece 58, or through separate pneumatic lines.

Referring to FIG. 3A, the input drive for rotating both stripper cylinder 28 and eccentric cylinder 40 may be supplied from a motor, through gearing not shown, to a drive coupling 90 mounted on a bearing 91 surrounding shaft 48; it being understood that such drive may be positioned at either end of shaft 48. Coupling 90 may be removably connected to end support 66 by a plurality of bolts 92, or by other connector means known per se. End support 66 drives the left end of stripping cylinder 28 through semi-circular plate 70, pins 80 and support ring 64 as previously described.

Figure 6:
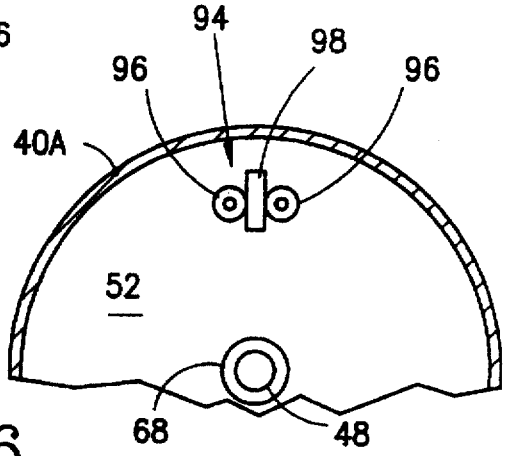
FIG. 6 is a schematic partial view of the details of the torque transmitting elements taken along view line 6—6 of FIG. 3A.

With respect to driving inner eccentric cylinder 40, end support 66 drives connector 52 through a coupling 94, one type of which is illustrated in FIGS. 3A and 6. Coupling 94 preferably comprises a pair of rollers 96 mounted on pins 100 connected to connector piece 52 and extending axially toward end support 66. Rollers 96 engage opposite sides of an abutment 98 connected to end support 66. In this manner, abutment 98 transmits torque from end support 66 through rollers 96 to connector 52 while, at the same time, permitting the required relative radial movement between stripper cylinder 28 and eccentric cylinder section 40A. This torque is then transmitted from eccentric cylinder section 40A to cylinder section 40B through support rings 54, 56 and bridge piece 58 as previously described.

From the foregoing description of one preferred embodiment, it will be apparent that the present invention solves the severe problem of the greater axial lengths of rotary pin strippers in a manner which provides for support of the stripper cylinder at its mid-section, while also transmitting torque from one eccentric cylinder section to the other, and which further provides for the extremely rapid and easy removal of the stripping cylinder halves as well as each of the eccentric cylinder sections. It will also be understood that numerous variations will become apparent to those skilled in the art of pin strippers, and that the foregoing description of one embodiment of the invention is intended to be purely illustrative of the principles of the invention, rather than limiting thereof, and that the legal scope of the invention is not intended to be limited other than as set forth in the following claims interpreted under the doctrine of equivalents.

What is claimed is:

1. A pin stripper comprising in combination:

(a) an outer stripper cylinder rotating about a first axis;

(b) an inner eccentric cylinder rotating about a second axis, said axes being parallel and non-coincident;

(c) said eccentric cylinder comprising first and second sections, said sections being spaced apart along said second axis;

(d) said stripper cylinder having an annular support ring, said annular support ring extending radially inwardly between said first and second eccentric cylinders sections;

(e) a support shaft extending axially along said first axis;

(f) a bridge piece mounted on said support shaft at an axial position along said shaft adjacent said support ring; and (g) torque transmitting means connecting said bridge piece to each of said first and second eccentric cylinder sections.

2. The pin stripper of claim 1 wherein said support shaft is stationary and said bridge piece is bearing-mounted on said stationary shaft.

3. The pin stripper of claim 1 wherein said torque transmitting means comprise first and second annular rings connected to said first and second eccentric cylinder sections, respectively, and first and second drive elements connected to said first and second annular rings, respectively, and to said bridge piece.

4. The pin stripper of claim 3 wherein said bridge piece includes axially extending holes, and said drive elements extend into said holes.

5. The pin stripper of claim 1 further including connector means connecting said bridge piece to said annular support ring.

6. The pin stripper of claim 5 wherein said connector means comprise a plurality of pins extending between said bridge piece and said annular support ring.

7. The pin stripper of claim 6 wherein said connector means include a plurality of pistons connected to said pins for moving said pins into and out of engagement to lock and unlock said bridge piece and said support ring.

8. A pin stripper comprising in combination:

(a) a stripper cylinder, said stripper cylinder comprising separate first and second circumferentially extending semi-cylindrical half sections;

(b) first and second semi-annular support rings connected to at least one end of each of said first and second half sections, respectively;

(c) an eccentric cylinder mounted for rotation within and eccentric to said stripper cylinder;

(d) a stationary support shaft having a longitudinal axis;

(e) an end support for supporting said stripper cylinder on said support shaft concentric to said longitudinal axis; and (f) a plurality of axially extending fluid actuated pins removably connecting said semi-annular support rings to said end support for removing said first and second half sections of said stripper cylinder upon retraction of said axially extending pins.

9. The pin stripper of claim 8 further including pistons connected to said fluid actuated pins, and means for fluid actuating said pistons to move said fluid actuated pins.

10. The pin stripper of claim 9 wherein said support shaft is stationary, and wherein first and second bearing means mount said stripper cylinder and said eccentric cylinder, respectively, on said stationary support shaft.

11. The pin stripper of claim 10 further including eccentric journal means on said stationary support shaft for rotating said eccentric cylinder about an axis parallel to and spaced from said longitudinal axis, and means for transmitting torque from said stripper cylinder to said eccentric cylinder.

12. The pin stripper of claim 11 wherein said means for transmitting torque include a first axially extending abutment connected to said end support and a second axially extending abutment connected to said eccentric cylinder, said first and second abutments being in engagement with each other.

13. The pin stripper of claim 12 wherein said second abutment comprises a roller mounted for rotation in a plane transverse to said longitudinal axis.

14. A rotary pin stripper for removing scrap pieces from die cut sheets comprising:

(a) a stationary support shaft;

(b) a pin stripper cylinder mounted for rotation concentric to said support shaft;

(c) an eccentric journal mounted on said support shaft;

(d) an eccentric cylinder mounted on said eccentric journal for non-concentric rotation about said support shaft;

(e) mounting means for removably mounting said stripper cylinder on said support shaft;

(f) an annular support ring extending circumferentially about the interior surface of said stripper cylinder, said support ring being positioned adjacent the center portion of said stationary support shaft; and (g) support means positioned on and adjacent the center portion of said stationary shaft, said support means engaging and supporting said support ring.

15. The rotary pin stripper of claim 14 wherein said mounting means include fluid actuated means.

16. The rotary pin stripper of claim 15 wherein said mounting means include an end support, and fluid actuated pins removably securing said stripper cylinder to said end support.

17. The rotary pin stripper of claim 14 including fluid actuated means removably connecting said support ring to said support means positioned adjacent the center portion of said stationary shaft.

18. The rotary pin stripper of claim 14 wherein said eccentric cylinder is comprised of at least two axially extending cylinder sections, and means for transmitting torque from one cylinder section to the other cylinder section.

19. The rotary pin stripper of claim 18 wherein said support means on said shaft include bearing means between said shaft and said support means, and means connecting said support means to each of said cylinder sections.

20. The rotary pin stripper of claim 14 including means for transmitting torque from said stripper cylinder to said eccentric cylinder, said torque transmitting means including at least one abutment connected to one of said cylinders and a roller positioned for engagement with said abutment connected to the other of said cylinders.

* * * * *